US010299056B2

(12) United States Patent
Walsh et al.

(10) Patent No.: US 10,299,056 B2
(45) Date of Patent: May 21, 2019

(54) SPATIAL AUDIO ENHANCEMENT PROCESSING METHOD AND APPARATUS

(71) Applicant: Creative Technology Ltd, Singapore (SG)

(72) Inventors: Martin Walsh, Scotts Valley, CA (US); Jean-Marc Jot, Aptos, CA (US); Edward Stein, Capitola, CA (US)

(73) Assignee: Creative Technology Ltd, Singapore (SG)

( * ) Notice: Subject to any disclaimer, the term of this patent is extended or adjusted under 35 U.S.C. 154(b) by 668 days.

(21) Appl. No.: 14/144,546

(22) Filed: Dec. 30, 2013

(65) Prior Publication Data

US 2014/0270281 A1 Sep. 18, 2014

Related U.S. Application Data

(63) Continuation of application No. 11/835,403, filed on Aug. 7, 2007, now Pat. No. 8,619,998.
(Continued)

(51) Int. Cl.

| | |
|---|---|
| ***H04S 1/00*** | (2006.01) |
| ***H04S 3/02*** | (2006.01) |
| *H04S 5/00* | (2006.01) |
| *H04S 7/00* | (2006.01) |
| *G10L 19/008* | (2013.01) |

(52) U.S. Cl.
CPC ..... *H04S 1/002* (2013.01); *H04S 3/02* (2013.01); *G10L 19/008* (2013.01); *H04S 5/00* (2013.01); *H04S 5/005* (2013.01); *H04S 7/00* (2013.01); *H04S 2400/01* (2013.01); *H04S 2420/01* (2013.01)

(58) Field of Classification Search
CPC ... H03S 3/02; H04S 5/005; H04S 7/00; H04S 2400/05; H04S 3/002; H04S 2400/01; H04S 3/00; H04S 2400/03; G10L 19/008
USPC ..... 381/17–23, 71.2, 98, 119, 27, 61
See application file for complete search history.

(56) References Cited

U.S. PATENT DOCUMENTS 5,027,403 A * 6/1991 Short ..... H04N 5/607 348/E5.125
5,172,415 A * 12/1992 Fosgate ..... H04S 5/005 381/22

(Continued)

FOREIGN PATENT DOCUMENTS

EP 1260119 B1 * 5/2006 ..... H04S 5/005

OTHER PUBLICATIONS

Gerson, Ambisonics in Multichannel Broadcasing and Video, AES, 1985.*
Gerson,Stereo Shuffling New Approach, old Techniques, 1986.*

*Primary Examiner* — Davetta W Goins
*Assistant Examiner* — Kuassi A Ganmavo
(74) *Attorney, Agent, or Firm* — Russell Swerdon; Desmund Gean

(57) ABSTRACT

An audio processing system for processing a single channel audio signal includes a a processor configured to derive a synthetic difference component from the single channel audio input signal a filtering module configured to apply a first filter to the sum signal represented by the single channel signal and to apply a second filter to the synthetic difference signal; and a control module configured to crossfade to control the amount of the resulting audio signal effect by respectively scaling the sum signal and the difference signal.

11 Claims, 17 Drawing Sheets

Related U.S. Application Data

(60) Provisional application No. 60/821,702, filed on Aug. 7, 2006.

(56) References Cited

U.S. PATENT DOCUMENTS

| | | | | | |
|---|---|---|---|---|---|
| 5,504,819 | A * | 4/1996 | Fosgate | H04S 5/005 | 381/18 |
| 5,579,396 | A * | 11/1996 | Iida | H04S 1/002 | 381/1 |
| 5,862,228 | A * | 1/1999 | Davis | H04S 3/02 | 381/17 |
| 7,412,380 | B1 * | 8/2008 | Avendano | G10L 21/00 | 381/1 |
| 7,920,711 | B2 * | 4/2011 | Takashima | H04S 5/005 | 379/406.01 |
| 8,442,241 | B2 * | 5/2013 | Yamada | G10L 19/008 | 381/17 |
| 2005/0008170 | A1 * | 1/2005 | Pfaffinger | H04S 7/30 | 381/96 |
| 2005/0220312 | A1 * | 10/2005 | Kasai | H04S 1/002 | 381/97 |
| 2006/0188101 | A1 * | 8/2006 | Gunnarsson | H04S 1/002 | 381/1 |
| 2007/0002971 | A1 * | 1/2007 | Purnhagen | H04R 5/00 | 375/316 |
| 2007/0172086 | A1 * | 7/2007 | Dickins | H04S 3/004 | 381/309 |
| 2008/0091436 | A1 * | 4/2008 | Breebaart | H04S 5/005 | 704/500 |
| 2009/0252339 | A1 * | 10/2009 | Obata | H04S 5/02 | 381/18 |

* cited by examiner

SPATIAL AUDIO ENHANCEMENT PROCESSING METHOD AND APPARATUS

CROSS-REFERENCES TO RELATED APPLICATIONS

This application is a continuation of and claims priority to U.S. patent application Ser. No. 11/833,403, filed Aug. 7, 2007, which claims priority from provisional U.S. Patent Application Ser. No. 60/821,702, filed Aug. 7, 2006, titled "STEREO SPREADER AND CROSSTALK CANCELLER WITH INDEPENDENT CONTROL OF SPATIAL AND SPECTRAL ATTRIBUTES", the disclosures of which are incorporated herein by reference in their entirety.

BACKGROUND OF THE INVENTION

1. Field of the Invention

The present invention relates to signal processing techniques. More particularly, the present invention relates to methods for processing audio signals.

2. Description of the Related Art

The majority of the stereo spreader designs implemented today use a so called stereo shuffling topology that splits an incoming stereo signal into its mid (M=L+R) and side (S=L−R) components and then processes those S and M signals with complementary low and highpass filters. The cutoff frequencies of these low and high-pass filters are generally tuned by ear. The resultant S' and M' signals are recombined such that 2L=M+S and 2R=M−S. Unfortunately, the end result usually yields a soundfield that is beyond the physical loudspeaker arc but is not precisely localized in space. What is desired is an improved stereo spreading method.

The M-S matrix can have other novel applications to spatial audio beyond the stereo spreader.

It is often desirable to reproduce binaural material over loudspeakers. In general, the aim of a crosstalk canceller is to cancel out the contra-lateral transmission path Hc such that the signal from the left speaker is heard at the left eardrum only and the signal from the right speaker is heard at the right eardrum only.

Traditional feedback crosstalk canceller designs require that the interaural transfer function (ITF) be constrained to be less than 1.0 for all frequencies. Tuning the spectral response of a traditional recursive crosstalk canceller filter design in order to control the perceived timbre is difficult or impractical. It is desirable to provide an improved crosstalk cancellation circuit that can allow tuning of the timbre of the canceller output without seriously affecting the spatial characteristics. Further it would be desirable to avoid possible sources of instability or signal clipping.

SUMMARY OF THE INVENTION

The present invention describes techniques that can be used to provide novel methods of spatial audio rendering using adapted M-S matrix shuffler topologies. Such techniques include headphone and loudspeaker-based binaural signal simulation and rendering, stereo expansion, multichannel upmix and pseudo multichannel surround rendering.

In accordance with another invention, a novel crosstalk canceller design methodology and topology combining a minimum-phase equalization filter and a feed-forward crosstalk filter is provided. The equalization filter can be adapted to tune the timbre of the crosstalk canceller output without affecting the spatial characteristics. The overall topology avoids possible sources of instability or signal clipping.

In one embodiment, the cross-talk cancellation uses a feed-forward cross-talk matrix cascaded with a spectral equalization filter. In one variation, this equalization filter is lumped within a binaural synthesis process preceding the cross-talk matrix. The design of the equalization filter includes limiting the magnitude frequency response at low frequencies.

These and other features and advantages of the present invention are described below with reference to the drawings.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

The M-S Shuffler Matrix

Figure 1:
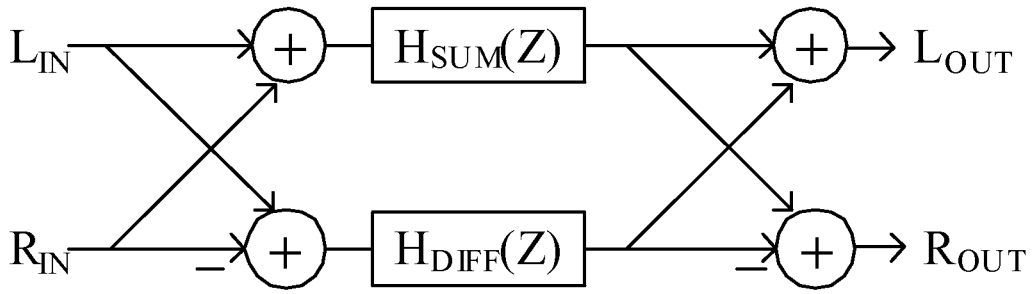
FIG. 1 is a diagram illustrating a general MS Shuffler Matrix.

The M-S shuffler matrix, also known as the stereo shuffler, was first introduced in the context of a coincident-pair microphone recording to adjust its width when played over two speakers. In reference to the left and right channels of a modern stereo recording, the M component can be considered to be equivalent to the sum of the channels and the S component equivalent to the difference. A typical M-S matrix is implemented by calculating the sum and difference of a two channel input signal, applying some filtering to one or both of those sum and difference channels, and once again calculating a sum and difference of the filtered signals, as shown in FIG. 1. FIG. 1 is a diagram illustrating a general MS Shuffler Matrix.

Figure 2:
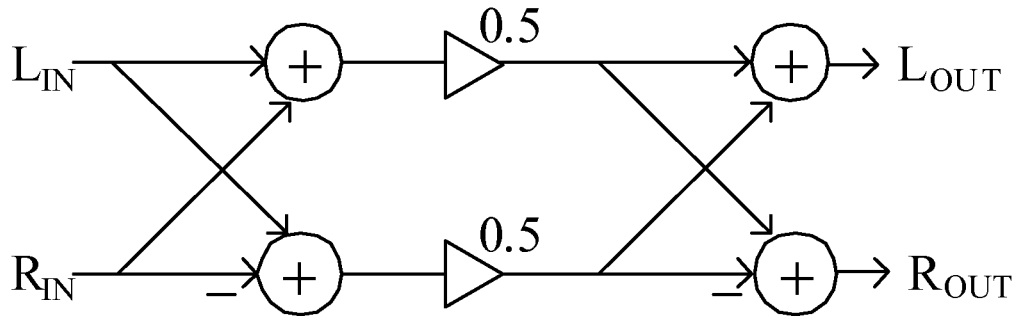
FIG. 2 is a diagram illustrating a general MS Shuffler Matrix set in bypass.
Figure 3:
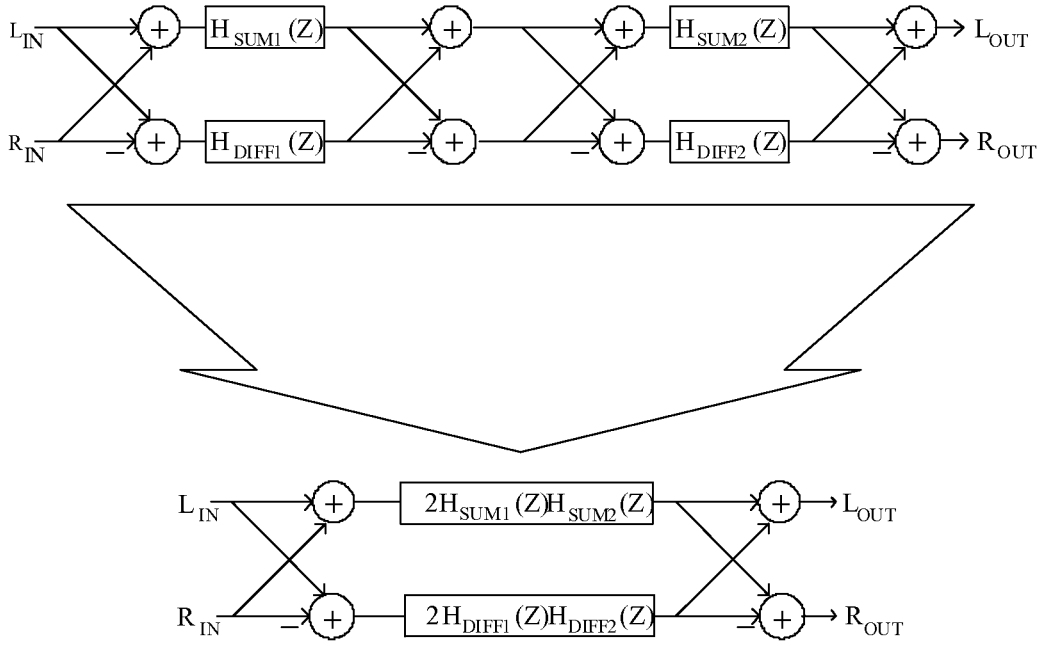
FIG. 3 is a diagram illustrating cascade of two MS Shuffler matrices.

The MS shuffler matrix has two important properties that will be used many times throughout this document: (1) The stereo shuffler has no effect at frequencies where the both the sum and difference filters are simple gains of 0.5. For example, for the topology given in FIG. 2, $L_{OUT}=L_{IN}$ and $R_{OUT}=R_{IN}$; (2) Two cascaded MS shuffler matrices can be replaced with a single matrix that has a sum and difference filter function that is twice the product of the original MS shuffler matrices' sum and difference filter functions. This property is illustrated in FIG. 3. FIG. 2 is a diagram illustrating a general MS Shuffler Matrix set in bypass. FIG. 3 is a diagram illustrating cascade of two MS Shuffler matrices.

Figure 4:
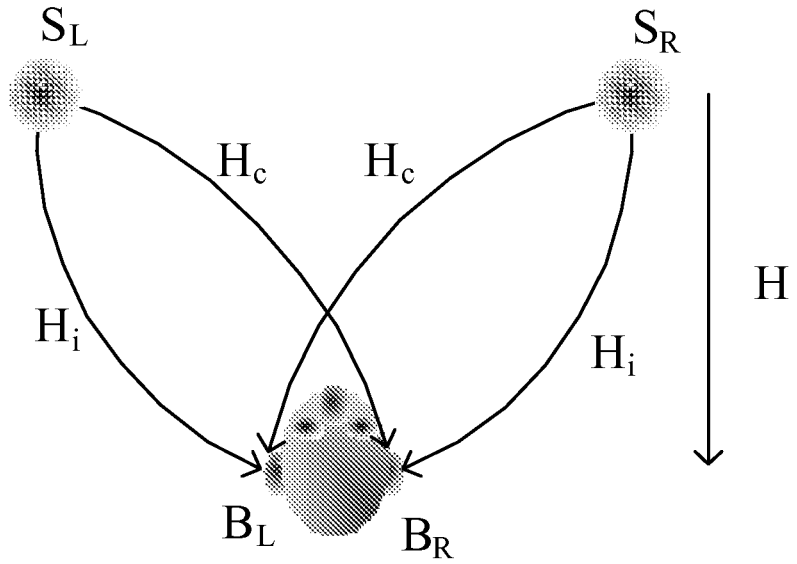
FIG. 4 is a diagram illustrating a simplified stereo speaker listening signal diagram.

The head related transfer function (HRTF) is often used as the basis for 3-D audio reproduction systems. The HRTF relates to the frequency dependent time and amplitude differences that are imposed on the wave front emanating from any sound source that are attributed to the listener's head (and body). Every source from any direction will yield two associated HRTFs. The ipsilateral HRTF, Hi, represents the path taken to the ear nearest the source and the contralateral HRTF, Hc, represents the path taken to the farthest ear. A simplified representation of the head-related signal paths for symmetrical two-source listening is depicted in FIG. 4. FIG. 4 is a diagram illustrating a simplified stereo speaker listening signal diagram. For simplicity, the set up also assumes symmetry of the listener's head.

Figure 5:
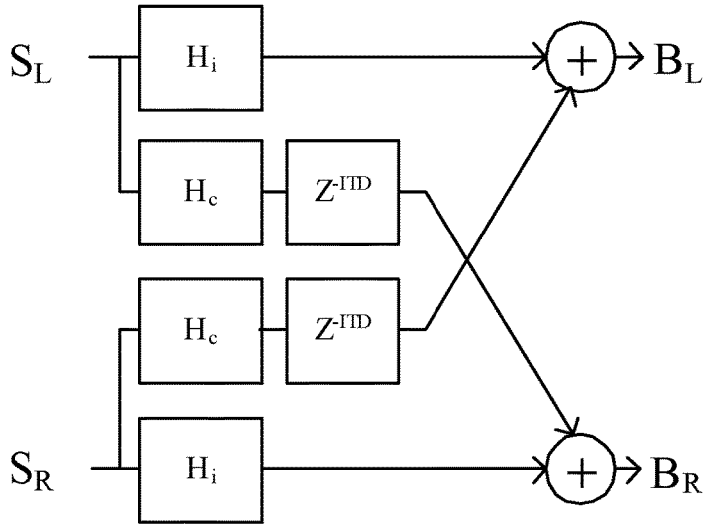
FIG. 5 is a diagram illustrating DSP simulation of loudspeaker signals (intended for headphone reproduction).

The audio signal path diagram shown in FIG. 4 can be simulated on a DSP system using the topology shown in FIG. 5. FIG. 5 is a diagram illustrating DSP simulation of loudspeaker signals (intended for headphone reproduction).

Figure 6:
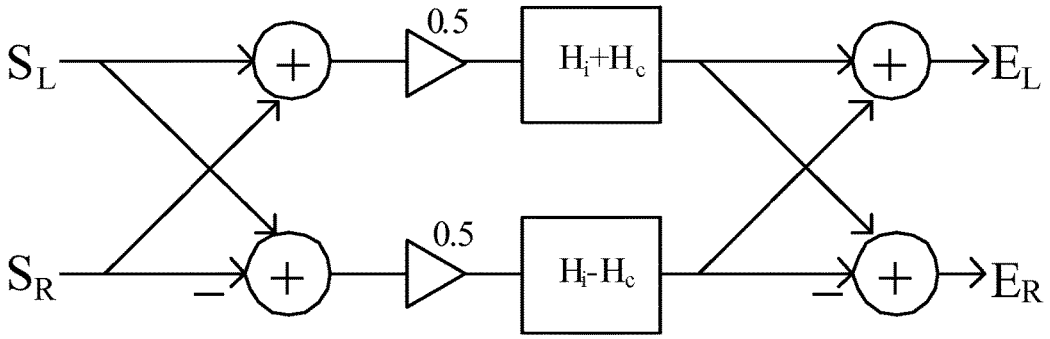
FIG. 6 is a diagram illustrating Symmetric HRTF pair implementation based on an M-S shuffler matrix.

Such a topology is often used when desired to simulate a typical stereo loudspeaker listening experience over headphones. In this case, the ipsilateral and contralateral HRTFs have been previously measured and are implemented as minimum phase digital filters. The time delays on the contralateral path, represented by $Z^{-ITD}$, represent an integer-sample time delay that emulates the time difference due to different signal path lengths between the source and the nearest and farthest ears. The traditional HRTF implementation topology of FIG. 5 can also be implemented using an M-S shuffler matrix. This alternative topology is shown in FIG. 6. FIG. 6 is a diagram illustrating Symmetric HRTF pair implementation based on an M-S shuffler matrix.

The sum and difference HRTF filters shown in FIG. 4 exhibit a property known as joint minimum phase. This property implies that the sum and difference filters can both be implemented using the minimum phase portions of their respective frequency responses without affecting the differential phase of the final output. This joint minimum phase property allows us to implement some novel effects and optimizations.

Figure 7:
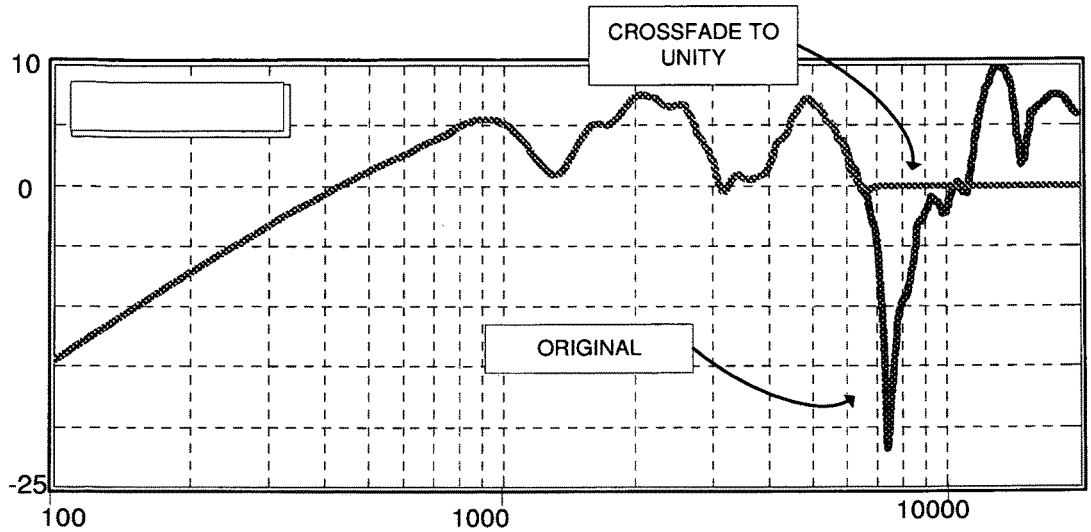
FIG. 7 is a diagram illustrating HRTF difference filter magnitude response featuring a 'fade-to-unity' at 7 kHz in accordance with one embodiment of the present invention.
Figure 8:
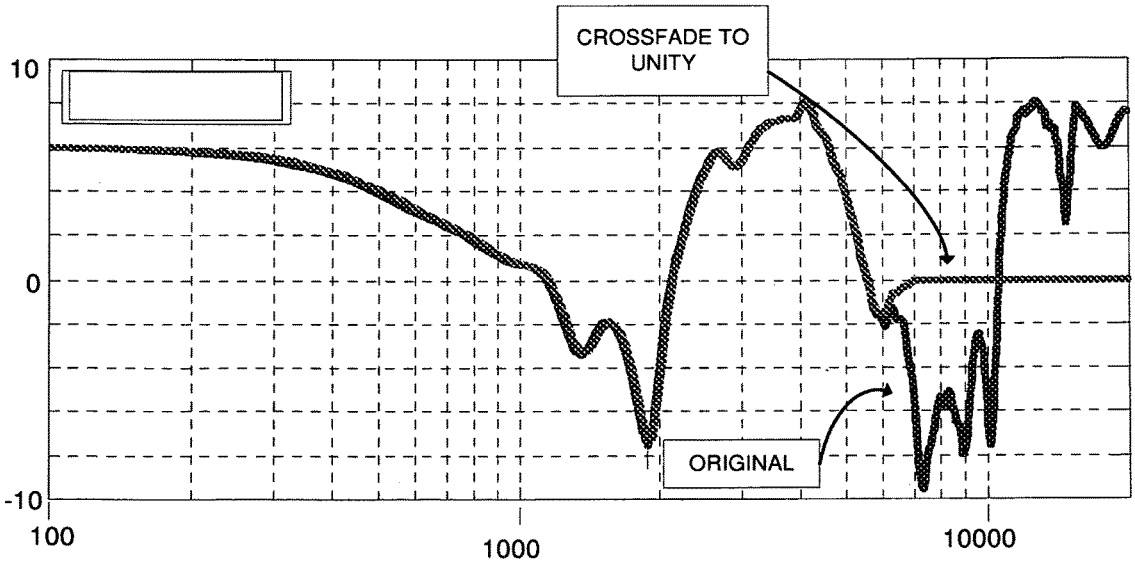
FIG. 8 is a diagram illustrating HRTF sum filter magnitude response featuring a 'fade-to-unity' at 7 kHz in accordance with one embodiment of the present invention.

In one embodiment, we cross fade the magnitudes of the sum and difference HRTF function's frequency response to unity at higher frequencies. This facilitates cost effective implementation and may also provide a way of minimizing undesirable high frequency timbre changes. After calculating the minimum-phase of the new magnitude response we are left with an implementation that performs the appropriate HRTF filtering at lower frequencies and transitions to an effect bypass at higher frequencies (using Property 1, described above). An example is provided in FIG. 7 and FIG. 8, where the magnitude response of the difference and sum HRTF filters are crossfaded to unity at around 7 kHz.

Figure 9:
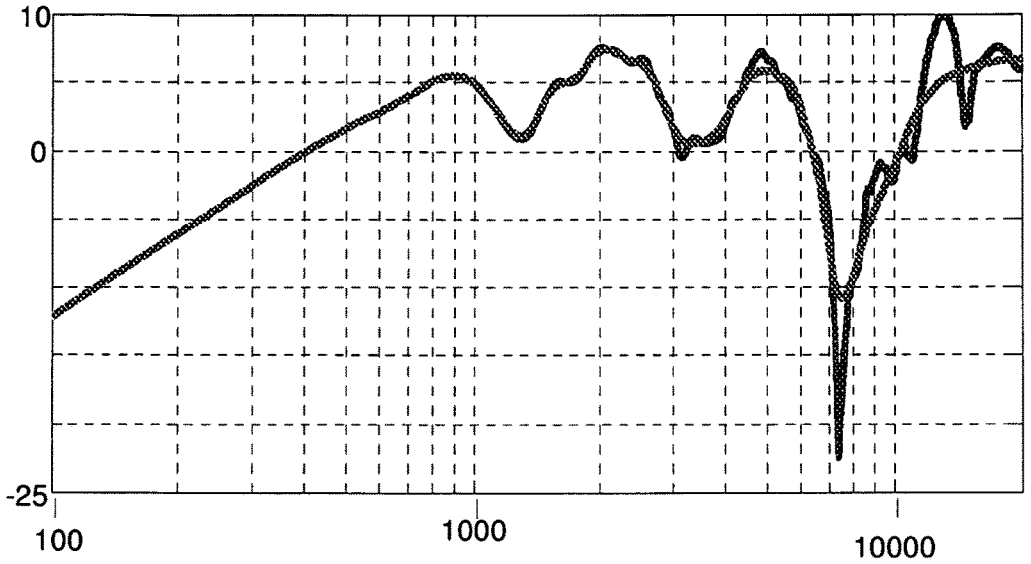
FIG. 9 is a diagram illustrating HRTF difference filter magnitude response featuring 'multiband smoothing in accordance with one embodiment of the present invention.
Figure 10:
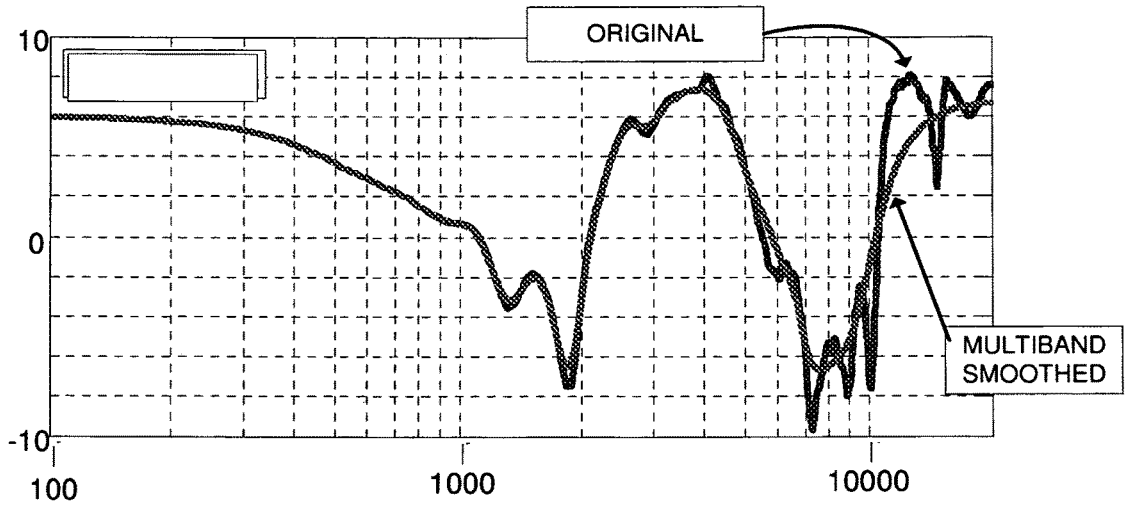
FIG. 10 is a diagram illustrating HRTF difference filter magnitude response featuring 'multiband smoothing in accordance with one embodiment of the present invention.

In accordance with another embodiment, we utilize the fact that we do not need to take the complex frequency response of the sum and difference filters into consideration until final implementation. We smooth the HRTF magnitude response to a differing degree in different frequency bands without worrying about consequences to the phase response. This can be done using either critical band smoothing or by splitting the frequency response into a fixed number of bands (for example, low, mid and high) and performing a radically different degree of smoothing per band. This allows us to preserve the most important head-related spatial cues (at the lowest frequencies) and smooth away the more-listener specific HRTF characteristics, such as those dependant on pinnae shape, at mid and high frequencies. By minimum phasing the resulting magnitude responses we ensure that the spatial attributes of the binaural signals are preserved at lower frequencies with greater (although less perceptually significant) errors at higher frequencies. An example is provided in FIG. 9 and FIG. 10, where the magnitude response of the difference and sum HRTF filters were split into three frequency bands [0-2 kHz, 2 kHz-5 kHz and 5 kHz-24 kHz]. In accordance with this embodiment, each band was independently critical band smoothed, with the lower band receiving very little smoothing and the upper band significantly critical-band smoothed. The three smoothed bands were then once again recombined and a minimum phase complex function derived from the resulting magnitude response.

This kind of smoothing and crossfading-to-unity significantly simplifies the sum and difference filter frequency responses. That, together with the fact that the sum and difference filters have been implemented using minimum phase functions (i.e. no need for a time delay) yields very low order IIR filter requirements for implementation. This low complexity of the sum and difference filter frequency responses, together with no requirement to directly implement an ITD makes it possible to consider analogue implementations where, before, they would have been very difficult or impossible.

Figure 11:
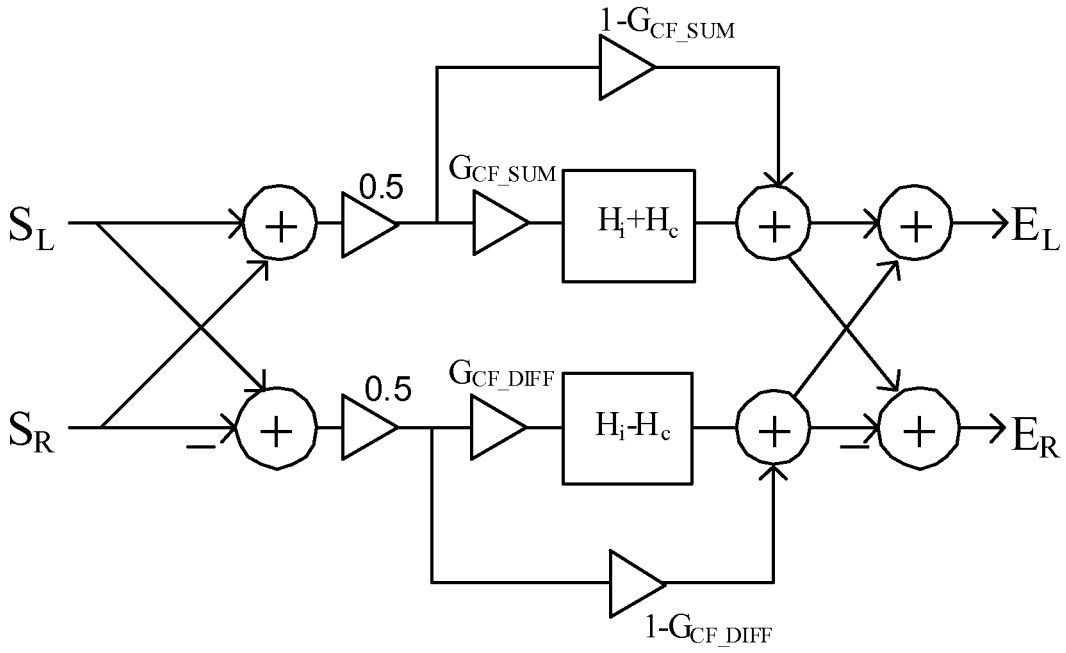
FIG. 11 is a diagram illustrating HRTF M-S shuffler with crossfade in accordance with one embodiment of the present invention.

In accordance with yet another embodiment, a novel crossfade between the full 3D effect and an effect bypass is implemented by the M-S shuffler implementation of an HRTF pair. Such a crossfade implementation is illustrated in FIG. 11. FIG. 11 is a diagram illustrating HRTF M-S shuffler with crossfade in accordance with one embodiment of the present invention. The crossfade coefficients GCF_SUM and GCF_DIFF allow us to present the listener with a full 3D effect (GCF_SUM=GCF_DIFF=1), no 3D effect (GCF_SUM=GCF_DIFF=0) and anything in between.

In accordance with another embodiment, the ability to crossfade between full 3D effect and no 3D effect allows us to provide the listener with interesting spatial transitions when the 3D effect is enabled and disabled. These transitions can help provide the listener with cues regarding what the effect is doing. It can also minimize the instantaneous timbre changes that can occur as a result of the 3D processing, which may be deemed undesirable to some listeners. In this case, the rate of change between CGF_SUM and CGF_DIFF can differ, allowing for interesting spatial transitions not possible with a traditional DSP effect crossfade. The listener could also be presented with a manual control that could allow him/her to choose the 'amount' of 3D effect applied to their source material according to personal taste. The scope of this embodiment of the present invention is not limited to any type of control. That is, the invention can be implemented using any type of suitable control, for a non-limiting example, a "slider" on a graphical user interface of a portable electronic device or generated by software running on a host computer.

Loudspeaker-Based 3D Audio Using the MS Shuffler Matrix

Figure 12:
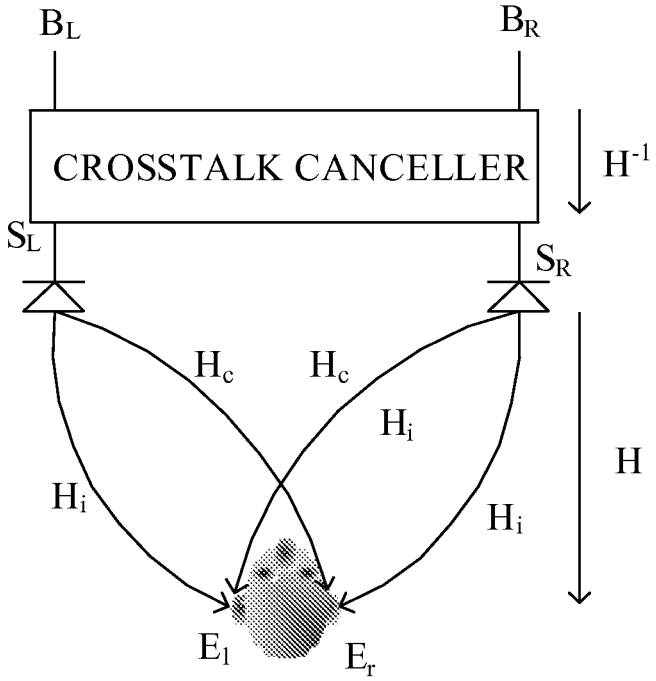
FIG. 12 is a diagram illustrating stereo speaker listening of a binaural source through a crosstalk canceller.

It is often desirable to reproduce binaural material over loudspeakers. The role of the crosstalk canceller is to post-process binaural signals so that the impact of the signal paths between the speakers and the ears are negated at the listeners' eardrums. A typical crosstalk cancellation system is shown in FIG. 12. In this diagram, BL and BR represent the left and right binaural signals. If the crosstalk canceller is designed appropriately, BL and only BL will be heard at the left eardrum (EL) and similarly, BR and only BR will be reproduced at the right eardrum (ER). Of course, such constraints are very difficult to comply with. Such a perfect system could exist only if the listener remained at exactly the same location relative to the design assumptions and if the design used the listener's exact physiology when producing the original recording and designing the crosstalk cancellation filter coefficients. Practical implementations have shown that such constraints are not actually necessary for accurate sounding binaural reproduction over speakers.

Figure 13:
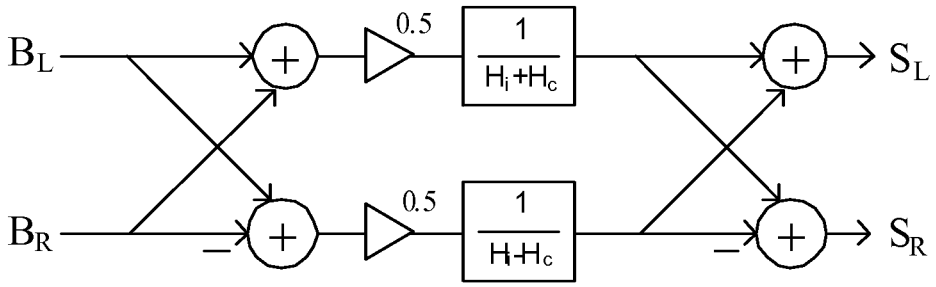
FIG. 13 is a diagram illustrating classic stereo shuffler implementation of the crosstalk canceller.

FIG. 13 shows the classic M-S shuffler based implementation of a crosstalk canceller. The sum and difference filters of the crosstalk canceller, at some symmetrical speaker listening angle, are the inverse of the sum and difference filters used to emulate a symmetrical HRTF pair at the same positions. Since the inverse of a minimum phase function is itself minimum phase, we can also implement the sum and difference filters of the cross talk canceller as minimum phase filters.

In general, the joint minimum-phase property of sum and difference filters for the crosstalk canceller implies that we can apply the same techniques as used in the symmetric HRTF pair M-S matrix implementation.

That is, the filter magnitude responses can be crossfaded to unity at higher frequencies, performing accurate spatial processing at lower frequencies and 'doing no harm' at higher frequencies. This is particularly of interest to crosstalk cancellation, where the inversion of the speaker signal path sums and differences can yield significant high frequency gains (perceived as undesirable resonance) when the listener is not exactly at the desired listening sweetspot. It is often better to opt to do nothing to the incoming signal than do potentially harmful processing.

The filter magnitude responses can also be smoothed by differing degrees based on increasing frequency, with higher frequency bands smoothed more than lower frequency bands, yielding low implementation cost and feasibility of analog implementations.

Accordingly, in one embodiment we apply a crossfading circuit around the sum and difference filters that allows the user to chose the amount of desired crosstalk cancellation and also to provide an interesting way to transition between headphone-targeted processing (HRTFs only) and loudspeaker-targeted (HRTFs+crosstalk cancellation).

Virtual Loudspeaker Pair

A virtual loudspeaker pair is a conceptual name given to the process of using a combination of binaural synthesis and crosstalk cancellation in cascade to generate the perception of a symmetric pair of loudspeaker signals from specific directions typically outside of the actual loudspeaker arc. The most common application of this technique is the generation of virtual surround speakers in a 5.1 channel playback system. In this case, the surround channels of the 5.1 channel system are post-processed such that they are implemented as virtual speakers to the side or (if all goes well), behind the listener using just two front loudspeakers.

Figure 14:
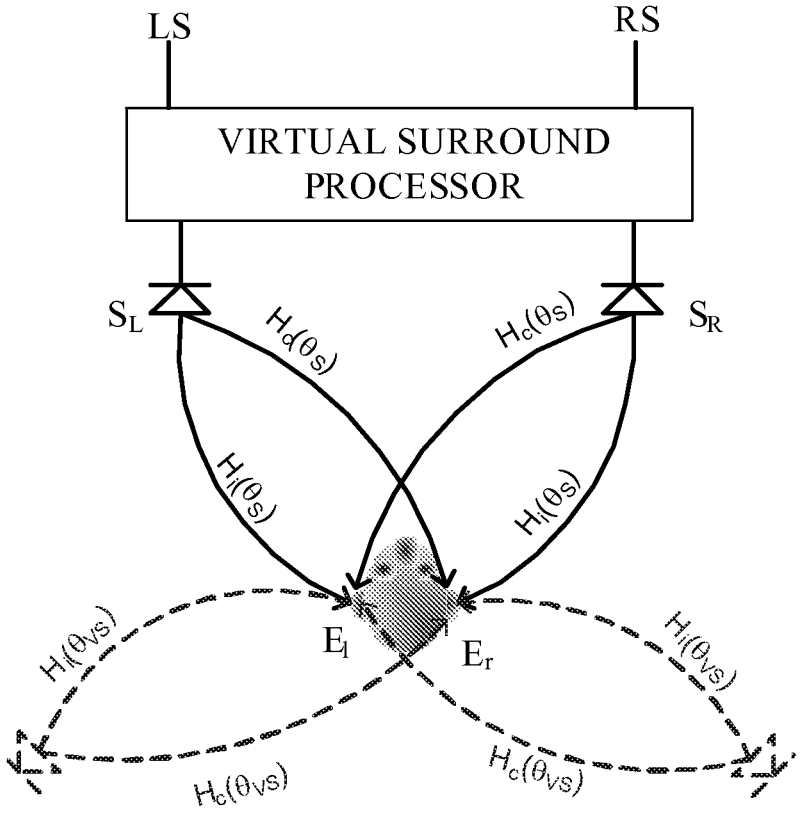
FIG. 14 is a diagram illustrating actual and desired signal paths for a virtual surround speaker system.
Figure 15:
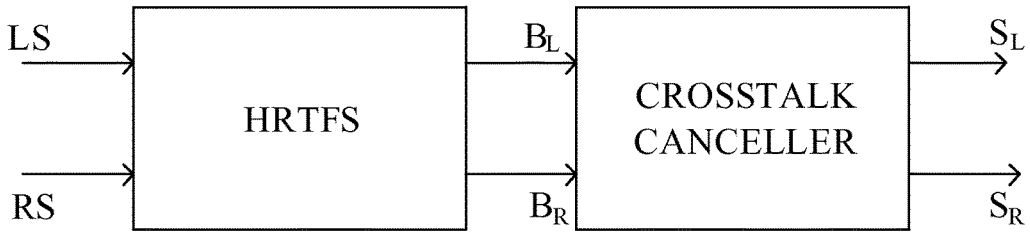
FIG. 15 is a diagram illustrating typical virtual loudspeaker implementation in accordance with one embodiment of the present invention.

A typical virtual surround system is shown in FIG. 14. To enable this process, a binaural equivalent of the left surround and right surround speakers must be created using the ipsilateral and contralateral HRTFs measured for the desired angle of the virtual surround speakers, $\Theta_{VS}$. The resulting binaural signal must also be formatted for loudspeaker reproduction through a crosstalk canceller that is designed using ipsilateral and contralateral HRTFs measured for the physical loudspeaker angles, $\Theta_S$. Typically, the HRTF and crosstalk canceller sections are implemented as separate cascaded blocks, as shown in FIG. 15.

This invention permits the design of virtual loudspeakers at specific locations in space and for specific loudspeaker set ups using objective methodology that can be shown to be optimal using objective means.

The described design provides several advantages including improvements in the quality of the widened images. The widened stereo sound images generated using this method are tighter and more focused (localizable) than with traditional shuffler-based designs. The new design also allows precise definition of the listening arc subtended by the new soundstage, and allows for the creation of a pair of virtual loudspeakers anywhere around the listener using a single minimum phase filter. Another advantage is providing accurate control of virtual stereo image width for a given spacing of the physical speaker pair.

This design preferably includes a single minimum phase filter. This makes analogue implementation an easy option for low cost solutions. For example, of a pair of virtual loudspeakers can be placed anywhere around the listener using a single minimum phase filter.

The new design also allows preservation of the timbre of center-panned sounds in the stereo image. Since the mid (mono) component of the signal is not processed, center-panned ('phantom center') sources are not affected and hence their timbre and presence are preserved.

Figure 16:
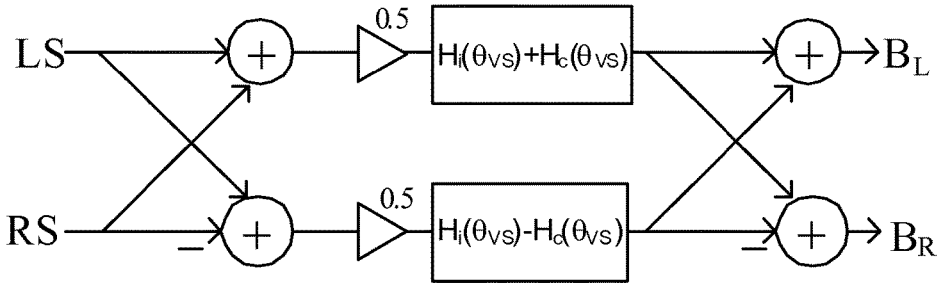
FIG. 16 is a diagram illustrating artificial binaural implementation of a pair of surround speaker signals at angle $\pm\theta_{VS}$ in accordance with one embodiment of the present invention.
Figure 17:
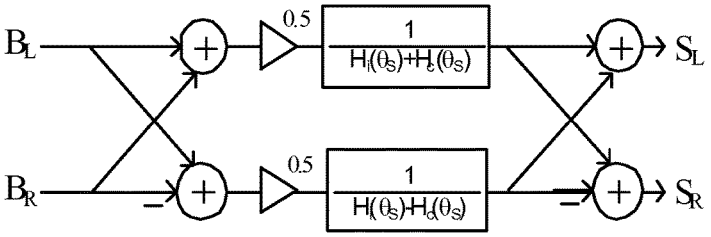
FIG. 17 is a diagram illustrating crosstalk canceller implementation for a loudspeaker angle of $\pm\theta_S$ in accordance with one embodiment of the present invention.

It has already been shown that both of these sections could be individually implemented in an M-S shuffler configuration. For example, in this virtual surround speaker case the HRTFs could be implemented as shown in FIG. 16, while the crosstalk canceller could be implemented as shown in FIG. 17. FIG. 16 is a diagram illustrating artificial binaural implementation of a pair of surround speaker signals at angle $\pm\theta_{VS}$ in accordance with one embodiment of the present invention. FIG. 17 is a diagram illustrating crosstalk canceller implementation for a loudspeaker angle of $\pm\theta_S$ in accordance with one embodiment of the present invention.

These two M-S shuffler matrices can be combined to generate a virtual loudspeaker pair. Using MS matrix property 2 we eliminate one of the M-S matrices by simply multiplying the HRTF and crosstalk sum and difference functions of each individual matrix and using the result for our new virtual speaker sum and difference functions. The new sum and difference EQ functions can now be defined by $$VS_{SUM} = \frac{H_i(\theta_{VS}) + H_C(\theta_{VS})}{H_i(\theta_S) + H_C(\theta_S)} \quad \text{Equation 1}$$

$$VS_{DIFF} = \frac{H_i(\theta_{VS}) - H_C(\theta_{VS})}{H_i(\theta_S) - H_C(\theta_S)} \quad \text{Equation 2}$$

Figure 18:
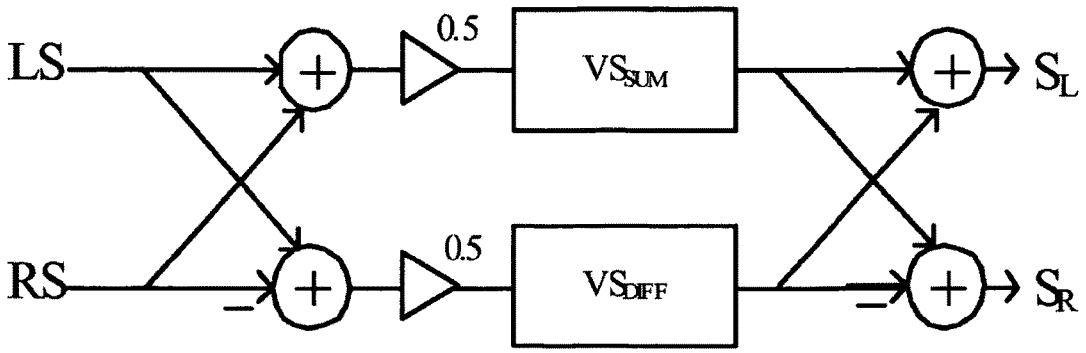
FIG. 18 is a diagram illustrating virtual speaker implementation based on the M-S Matrix in accordance with one embodiment of the present invention.

Any listener specific, but direction independent, HRTF contributions would cancel out of any loudspeaker-based virtual speaker implemented in this manner, assuming that all HRTF measurements were taken in the same session. This implies that measured HRTFs would require minimal post-processing. The new virtual speaker matrix is shown in FIG. 18. FIG. 18 is a diagram illustrating virtual speaker implementation based on the M-S Matrix in accordance with one embodiment of the present invention.

Since $VS_{SUM}$ and $VS_{DIFF}$ are derived from the product of two minimum phase functions, they can both be implemented as minimum phase functions of their magnitude response without appreciable timbre or spatial degradation of the resulting soundfield. This, in turn, implies that they inherit some of the advantageous characteristics of the HRTF and crosstalk shuffler implementations, i.e.

In accordance with any embodiment, the filter magnitude responses are crossfaded substantially to unity at higher frequencies, performing accurate spatial processing at lower frequencies and 'doing no harm' at higher frequencies. This is particularly of interest to virtual speaker based products, where the inversion of the speaker signal path sums and differences can yield high gains when the listener is not exactly at the desired listening sweetspot.

In accordance with yet another embodiment, the filter magnitude responses are smoothed by differing degrees based on increasing frequency, with higher frequency bands smoothed more than lower frequency bands, yielding low implementation cost and feasibility of analog implementations.

In a further embodiment, we apply crossfading circuits around the sum and difference filters that allow the user to chose the amount of desired 3D processing and also to provide an interesting way to transition between 3D processing and no processing.

The scope of the invention is not limited to a single frequency for cutting off crosstalk cancellation and an HRTF response. Thus, in one embodiment, we cross-fade to unity at a different frequency for the numerator and denominator of equation 1 and equation 2. This would allow us to avoid crosstalk cancellation above frequencies for which typical head movement distances are much greater than the wavelength of impinging higher frequency signals and still provide the listener with HRTF cues relating to the virtual source location up to a different, less constraining frequency range. This technique could also be used, for example, in a system where the same 3D audio algorithm is used for both headphone and loudspeaker reproduction. In this case, we could implement an algorithm that performs virtual loudspeaker processing up to some lower (for a non-limiting example, <500 Hz) frequency and HRTF based virtualization above that frequency.

The 'virtual loudspeaker' M-S matrix topology can be used to provide a stereo spreader or stereo widening effect, whereby the stereo soundstage is perceived beyond the physical boundaries of the loudspeakers. In this case, a pair of virtual speakers, with a wider speaker arc (e.g., ±30°) is generated using a pair of physical speakers that have a narrower arc (e.g., ±10°).

A common desirable attribute of such stereo widening systems, and one that is rarely met, is the preservation of timber for center panned sources, such as vocals, when the stereo widening effect is enabled. Preserving the center channel has several advantages other than the requirement of timbre preservation between effect on and effect off. This may be important for applications such as AM radio transmission or internet audio broadcasting of downmixed virtualized signals.

FIG. 18 illustrates that the filter $VS_{SUM}$ will be applied to all center-panned content if we use the M-S shuffler based stereo spreader. This can have a significant effect on the timbre of center panned sources. For example, assume we have a system that assumes loudspeakers will be positioned ±10° relative to the listener. We apply a virtual speaker algorithm in order to provide the listener with the perception that their speakers are at the more common stereo listening locations of ±30°.

Figure 19:
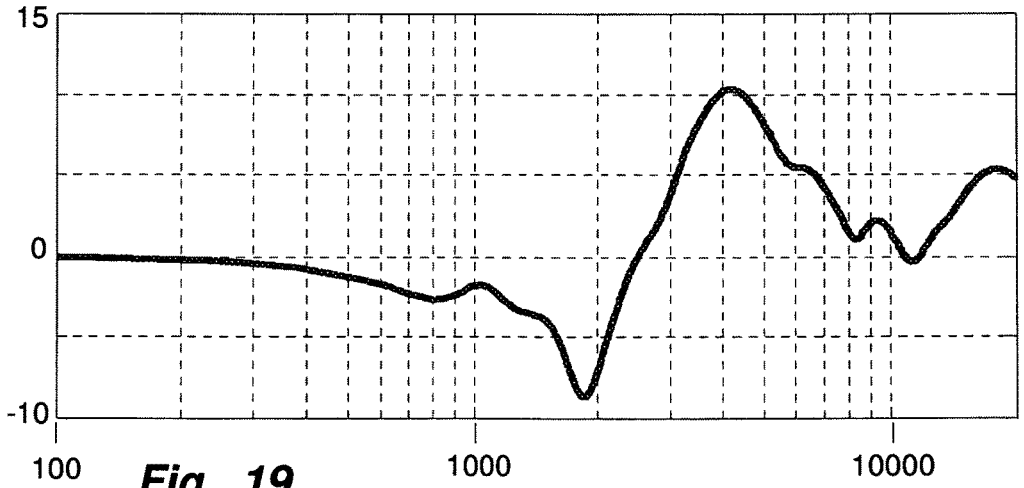
FIG. 19 is a diagram illustrating sum filter magnitude response for a physical speaker angle of ±10° and a virtual speaker angle of ±30° in accordance with one embodiment of the present invention.
Figure 20:
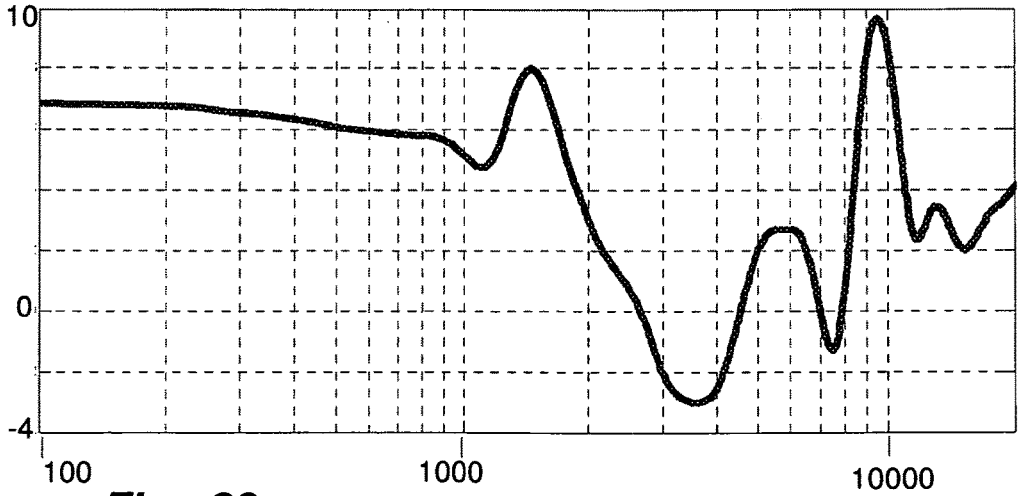
FIG. 20 is a diagram illustrating difference filter magnitude response for a physical speaker angle of ±10° and a virtual speaker angle of ±30° in accordance with one embodiment of the present invention.

Typical $VS_{SUM}$ and $VS_{DIFF}$ filter frequency responses derived from HRTFs measured at 10° and 30° are shown in FIG. 19 and FIG. 20. FIG. 19 is a diagram illustrating sum filter magnitude response for a physical speaker angle of ±10° and a virtual speaker angle of ±30° in accordance with one embodiment of the present invention. FIG. 20 is a diagram illustrating difference filter magnitude response for a physical speaker angle of ±10° and a virtual speaker angle of ±30° in accordance with one embodiment of the present invention. FIG. 19 highlights the amount of by which all mono (center panned) content will be modified—approximately ±10 dB.

Figure 21:
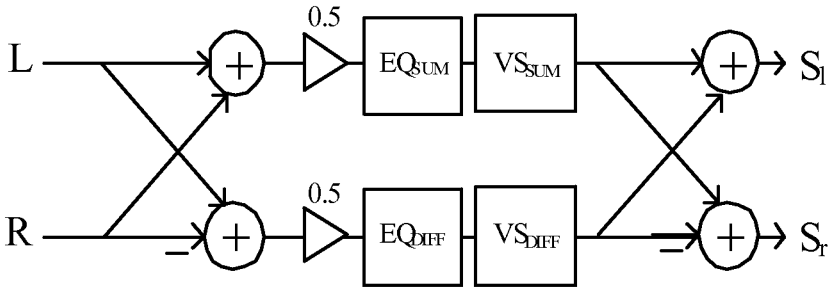
FIG. 21 is a diagram illustrating M-S matrix based virtual speaker widener system with additional EQ filters in accordance with one embodiment of the present invention.

An intuitive answer to this problem might be to simply remove the $VS_{SUM}$ filter. However, removing this filter would disturb the inter-channel level and phase at the shuffler's outputs and, consequently, the interaural level and phase at the listener's ears. In order to preserve the center channel timbre while preserving the spatial attributes of the design we utilize an additional EQ. FIG. 21 is a diagram illustrating M-S matrix based virtual speaker widener system with additional EQ filters in accordance with one embodiment of the present invention. FIG. 21 shows the original stereo widener implementation with an additional EQ applied to the sum and difference filters. This additional EQ will have no impact on the spatial attributes of the system so long as we modify the sum and difference signals in an identical manner, i.e. $EQ_{SUM}=EQ_{DIFF}$.

In accordance with another embodiment, in order to fully retain the timbre of the front-center image we select the additional EQ such that:

$$EQ_{SUM} = EQ_{DIFF} = \frac{1}{VS_{SUM}} \qquad \text{Equation 3}$$

Such a configuration yields the most ideal M-S matrix based stereo spreader solution that does not affect the original center panned images while retaining the spatial attributes of the original design.

It transpires; as a result of this additional filtering that stereo-panned images are now being filtered by some function between 1 and $EQ=1/VS_{SUM}$, relative to the original virtual speaker implementation, depending on their panned position, with hard-panned images exhibiting the largest timbre differences. For many applications, this is an undesirable outcome.

An ideal solution needs to make a compromise between undesirably filtered center panned sources and undesirably filtered hard panned sources. The problem here is that, for timbre preservation, we want the additional sum EQ filter to be close to $EQ_{SUM}=1/VS_{SUM}$ while we want the additional difference EQ filter to be close to $EQ_{DIFF}=1$, but both additional EQs must be the same in order to preserve the interaural phase.

In accordance with yet another embodiment we perform a weighted interpolation between the two extremes and model the resulting filter. The weighting is preferrably based on the requirements of the final system. For example, if the application assumes that there will be a prevalent amount of monophonic content, (perhaps a speaker system for a portable DVD player) $EQ_{DIFF}$ and $EQ_{SUM}$ might be designed to be closer to $1/VS_{SUM}$ to better preserve dialogue.

In accordance with yet another embodiment we specify the EQ filter in terms of a geometric mean function.

$$EQ_{SUM} = EQ_{DIFF} = \frac{1}{\sqrt{VS_{SUM}}} \qquad \text{Equation 4}$$

Using this method, the perceptual impact of center-panned timbre modification is halved (in terms of dB) compared to our original implementation. This modification implies that stereo-panned images are now being filtered by some function between 1 and $EQ=1/\sqrt{VS_{SUM}}$, relative to the original virtual speaker implementation, again half the perceptual impact as before.

In accordance with still another embodiment, we design the filters such that $$EQ * VS_{SUM} = EQ * VS_{DIFF} = \frac{H_i(\theta_{VS})}{H_i(\theta_S)} \qquad \text{Equation 5}$$

at higher frequencies. $H_i(\theta_{VS})$ and $H_i(\theta_S)$ represent the ipsilateral HRTFs corresponding to the virtual source position and the physical loudspeaker positions, respectively. In this case, we assume the incident sound waves from the loudspeaker to the contralateral ear are shadowed by the head at higher frequencies. This would mean that we are predominantly concerned with canceling the ipsilateral HRTF corresponding to the speaker and replacing it with the ipsilateral HRTF corresponding to the virtual sound source.

Multi-Channel Upmix Using the MS Shuffler Matrix

Multi-channel upmix allows the owner of a multichannel sound system to redistribute an original two channel mix between more than two playback channels. A set of N modified M-S shuffler matrices can provide a cost efficient method of generating a 2N-channel upmix, where the 2N output channels are distributed as N (left, Right) pairs.

Figure 22:
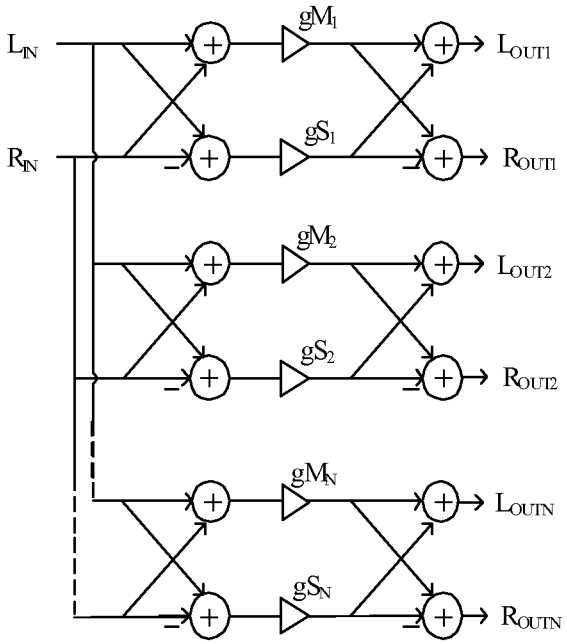
FIG. 22 is a diagram illustrating Generalized 2-2N upmix using M-S matrices in accordance with one embodiment of the present invention.

Accordingly, in one embodiment, an M-S shuffler matrix is used to generate a 2N-channel upmix. FIG. 22 is a diagram illustrating Generalized 2-2N upmix using M-S matrices in accordance with one embodiment of the present invention. The generalized approach to upmix using M-S matrixes is illustrated in FIG. 22. Gains $gM_i$ and $gS_i$ are tuned to redistribute the mid and side contributions from the stereo input across the 2N output channels. As a general rule, the M components of a typical stereo recording will contain the primary content and the S components will contain the more diffuse (ambience) content. If we wish to mimic a live listening space, the gains $gM_i$ should be tuned such that the resultant is steered towards the front speakers and the gains $gS_i$ should be tuned such that the resultant is equally distributed.

Figure 23:
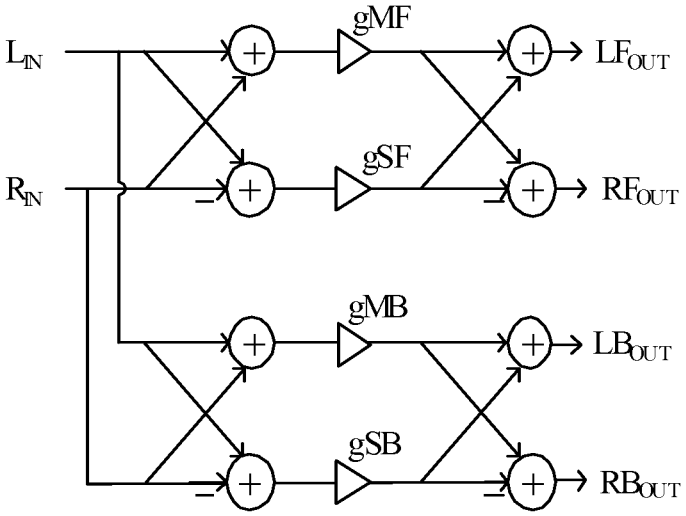
FIG. 23 is a diagram illustrating basic 2-4 channel upmix using M-S Shuffler matrices in accordance with one embodiment of the present invention.

FIG. 23 is a diagram illustrating basic 2-4 channel upmix using M-S Shuffler matrices in accordance with one embodiment of the present invention. In accordance with another embodiment, energy is preserved. In a 2-4-channel upmix example, as shown in FIG. 23. This can be achieved as follows:

Total Energy:

$$\text{Front energy}=LF^2+RF^2=gMF^2\cdot M^2+gSF^2\cdot S^2$$

$$\text{Back energy}=LB^2+RB^2=gMB^2\cdot M^2+gSB^2\cdot S^2$$

$$\text{Total energy}=(gMF^2+gMB^2)\cdot M^2+(gSF^2+gSB^2)\cdot S^2$$

Energy and balance preservation condition:

For any signal (L,R), output energy must be equal to input energy.

This means:

$$(gMF^2+gMB^2)\cdot M^2+(gSF^2+gSB^2)\cdot S^2=L^2+R^2=M^2+S^2.$$

In order to verify this condition for any (L,R) and therefore any (M,S), we need:

$$gMF^2+gMB^2=1 \text{ and } gSF^2+gSB^2=1$$

In accordance with yet another embodiment, control is provided for the front-back energy distribution of the M and/or S components. For a non-limiting example, the upmix parameters can be made available to the listener using a set of four volume and balance controls (or sliders):

Proposed volume and balance control parameters:

$$\text{M Level}=10\cdot\log 10(gMF^2+gMB^2) \text{ default: 0 dB}$$

$$\text{S Level}=10\cdot\log 10(gSF^2+gSB^2) \text{ default: 0 dB}$$

$$\text{M Front-Back Fader}=gMB^2/(gMF^2+gMB^2) \text{ range: 0-100\%}$$

$$\text{S Front-Back Fader}=gSB^2/(gSF^2+gSB^2) \text{ range: 0-100\%}$$

For M/S balance preservation, M Level=S Level.

Figure 24:
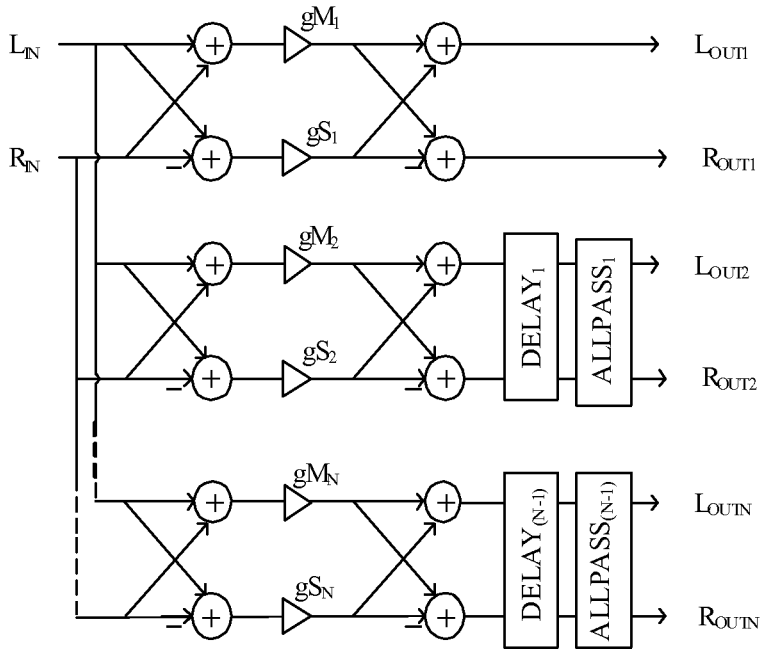
FIG. 24 is a diagram illustrating generalized 2-2N channel upmix with output decorrelation in accordance with one embodiment of the present invention.

In one variation, improved performance is expected from decorrelating the back channels relative to the front channels. For example, some delays and allpass filters can be inserted into some or all of the upmix channel output paths, as shown in FIG. 24. FIG. 24 is a diagram illustrating generalized 2-2N channel upmix with output decorrelation in accordance with one embodiment of the present invention.

Figure 25:
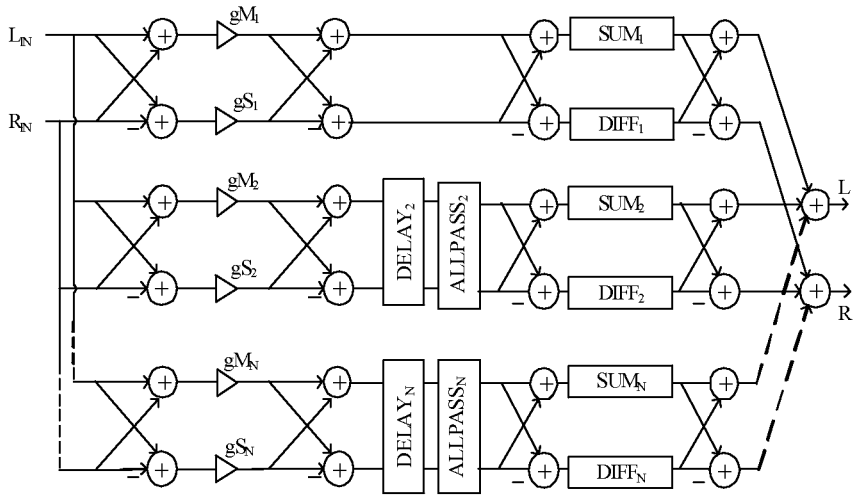
FIG. 25 is a diagram illustrating generalized 2-2N channel upmix with output decorrelation and 3D virtualization of the output channels in accordance with one embodiment of the present invention.

In accordance with yet another embodiment, the output of the upmix is virtualized using any traditional headphone or loudspeaker virtualization techniques, including those described above, as shown in the generalized 2-2N channel upmix shown in FIG. 25. FIG. 25 is a diagram illustrating generalized 2-2N channel upmix with output decorrelation and 3D virtualization of the output channels in accordance with one embodiment of the present invention.

Figure 26:
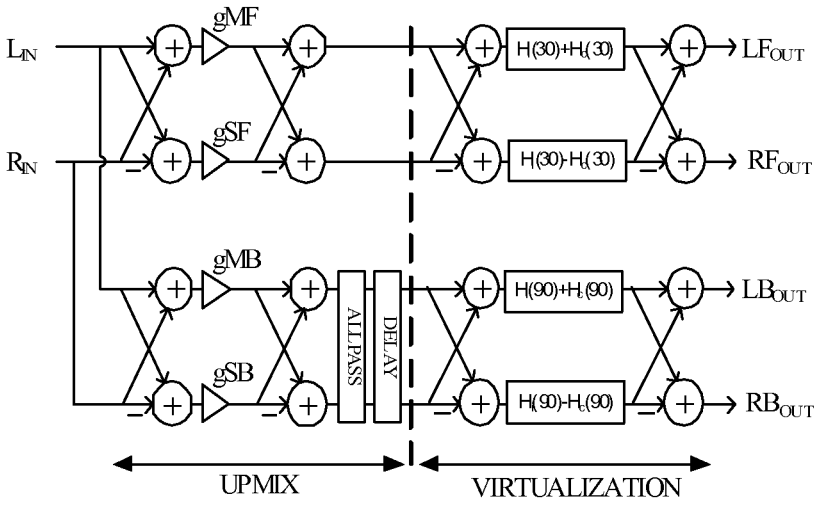
FIG. 26 is a diagram illustrating an example 2-4 channel upmix with headphone virtualization in accordance with one embodiment of the present invention.

In this figure, SUMi and DIFFi represent the sum and difference filter specifications of a the i'th symmetrical virtual headphone or loudspeaker pair. FIG. 26 is a diagram illustrating an example 2-4 channel upmix with headphone virtualization in accordance with one embodiment of the present invention.

Figure 27:
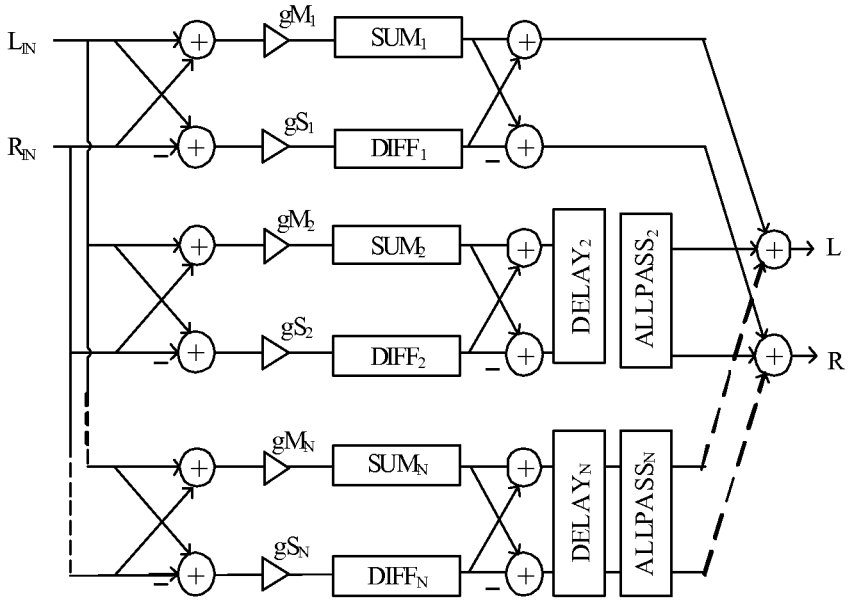
FIG. 27 is a diagram illustrating an alternative 2-2N channel upmix with output decorrelation and 3D virtualization of the output channels in accordance with one embodiment of the present invention.
Figure 28:
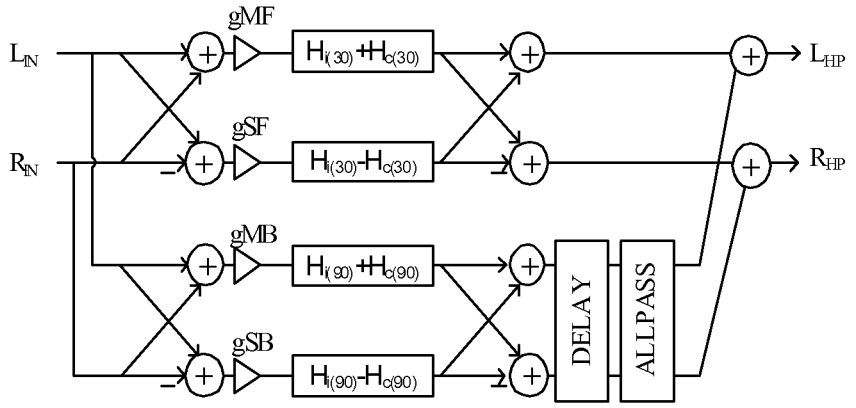
FIG. 28 is a diagram illustrating an alternative 2-4 channel upmix with headphone virtualization in accordance with one embodiment of the present invention.

In another embodiment and according to the second property of M-S matrices, described at the start of the specification, the upmix gains and the virtualization filters are combined. A generalized implementation of such a combined upmix and virtualizer implementation is shown in FIG. 27. FIG. 27 is a diagram illustrating an alternative 2-2N channel upmix with output decorrelation and 3D virtualization of the output channels in accordance with one embodiment of the present invention. SUMi and DIFFi represent the sum and difference stereo shuffler filter specifications of the i'th symmetrical virtual headphone or loudspeaker pair. An example 2-4 channel implementation, where the upmix is combined with headphone virtualization, is shown in FIG. 28.

One approach to obtain a compelling surround effect includes setting the S fader towards the back and the M fader towards the front. If we preserve the balance, this would cause gSB>gMB and gMF>gSF. The width of the frontal image would therefore be reduced. In one embodiment, this is corrected by widening the front virtual speaker angle.

Figure 29:
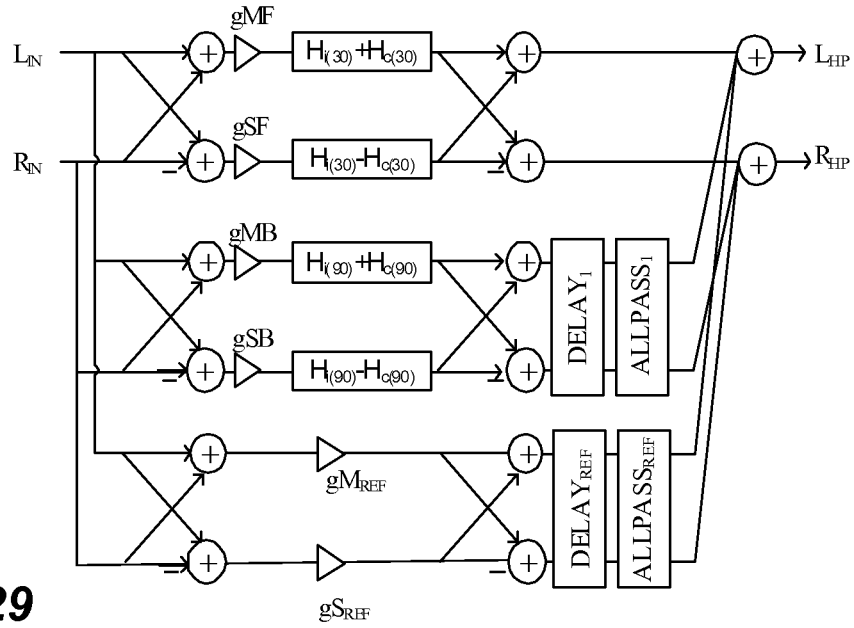
FIG. 29 is a diagram illustrating M-S shuffler-based 2-4 channel upmix for headphone playback with upmix in accordance with one embodiment of the present invention.

The M-S shuffler based upmix structure can be used as a method of applying early reflections to a virtual loudspeaker rendering over headphones. In this case, the delay and allpass filter parameters are adjusted such that their combined impulse response resembles a typical room response. The M and S gains within the early reflection path are also tuned to allow the appropriate balance of mid versus side components used as inputs to the room reflection simulator. These reflections can be virtualized, with the delay and allpass filters having a dual role of front/back decorrelator and/or early reflection generator or they can be added as a separate path directly into the output mix, as shown in an example implementation in FIG. 29. FIG. 29 is a diagram illustrating M-S shuffler-based 2-4 channel upmix for headphone playback with upmix in accordance with one embodiment of the present invention.

Although the upmix has been described as a 2-N channel upmix, the description as such has been for illustrative purposes and not intended to be limiting. That is, the scope of the invention includes at least any M-N channel upmix (M<N).

Pseudo Stereo/Surround Using the MS Shuffler Matrix

Figure 30:
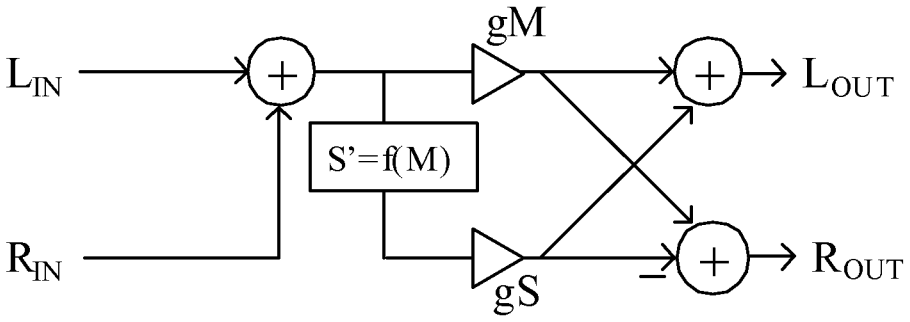
FIG. 30 is a diagram illustrating conceptual implementation of a pseudo stereo algorithm in accordance with one embodiment of the present invention.

As described earlier, any stereo signal can be apportioned into two mono components; a sum and a difference signal. A monophonic input (i.e. one that has the same content on the left and right channels) is 100% sum and 0% difference. By deriving a synthetic difference signal component from the original monophonic input and mixing back, as we do in any regular M-S shuffler, we can generate a sense of space equivalent to an original stereo recording. This concept is illustrated on FIG. 30. FIG. 30 is a diagram illustrating conceptual implementation of a pseudo stereo algorithm in accordance with one embodiment of the present invention.

Of course, if the input was purely monophonic, the output of the first 'difference' operation would be zero and this difference operation would be unnecessary in practice. For maximum effect, the processing involved in generating the simulated difference signal should be such that it generates an output that is temporally decorrelated with respect to the original signal. This could be in separate embodiments an allpass filter or a monophonic reverb, for example. In its simplest form, this operation could be a basic N-sample delay, yielding an output that is equivalent to a traditional pseudo stereo algorithm using the complementary comb method first proposed by Lauridsen.

In accordance with another embodiment, this implementation is expanded to a 1-N (N<2) channel 'pseudo surround' output by simulating additional difference channel components and applying them to additional channels.

Figure 31:
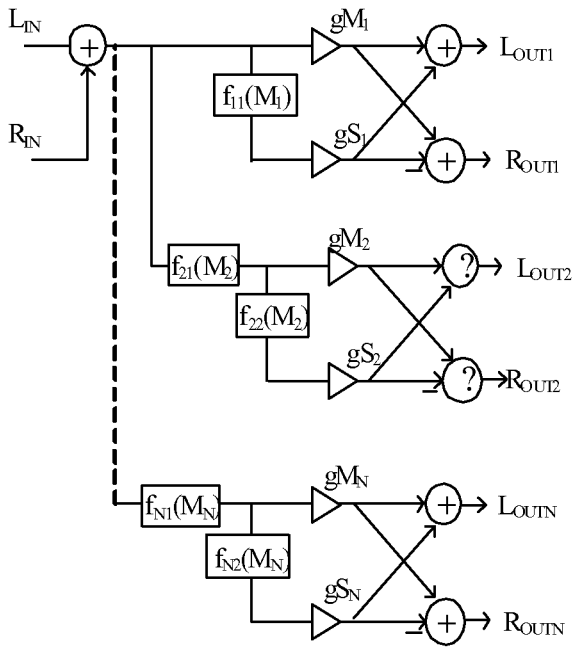
FIG. 31 is a diagram illustrating generalized 1-2N pseudo surround upmix in accordance with one embodiment of the present invention.

The monophonic components of the additional channels could also be decorrelated relative to one another and the input if so desired, in one embodiment. A generalized 1-2N pseudo surround implementation in accordance with one embodiment is shown in FIG. 31. The monophonic input components are decorrelated from one another using some function $f_{i1}(M_i)$. This is usually a simple delay, but other decorrelation methods could also be used and still be in keeping with the scope of the present invention. The difference signal is synthesized using $f_{i2}(M_i)$ represents a generalized temporal effect algorithm performed on the i'th monophonic component, as described above.

Figure 32:
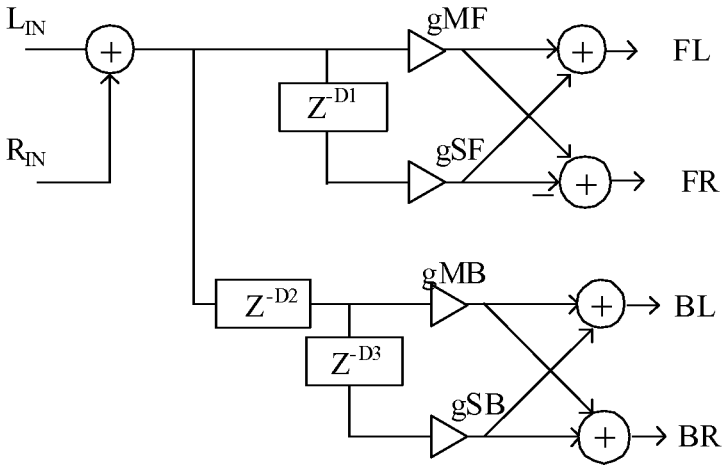
FIG. 32 is a diagram illustrating 1-4 channel pseudo surround upmix in accordance with one embodiment of the present invention.

In one embodiment control of the front-back energy distribution of the M and/or S components is provided. FIG. 32 is a diagram illustrating 1-4 channel pseudo surround upmix in accordance with one embodiment of the present invention. In a 2-4-channel pseudo surround implementation, such as the example shown in FIG. 32, the upmix parameters can be made available to the listener using a set of four volume and balance controls (or sliders):

Proposed volume and balance control parameters:

M Level=10·log 10($gMF^2$+$gMB^2$) default: 0 dB

S Level=10·log 10($gSF^2$+$gSB^2$) default: 0 dB

M Front-Back Fader=$gMB^2$/($gMF^2$+$gMB^2$) range: 0-100%

S Front-Back Fader=$gSB^2$/($gSF^2$+$gSB^2$) range: 0-100%

For M/S balance preservation, M Level=S Level.

While the main purpose of this kind of algorithm is to create a pseudo surround signal from a monophonic 2-channel ($L_{IN}$+$R_{IN}$) or single channel ($L_{IN}$ only) input, it works well as applied to a stereo input source.

Figure 33:
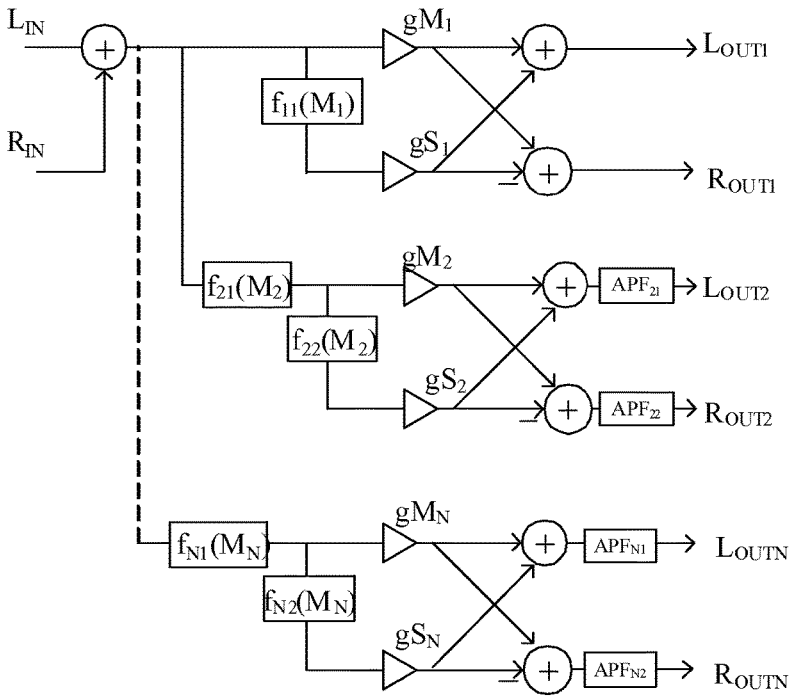
FIG. 33 is a diagram illustrating generalized 1-2N pseudo surround upmix with output decorrelation in accordance with one embodiment of the present invention.

FIG. 33 is a diagram illustrating generalized 1-2N pseudo surround upmix with output decorrelation in accordance with one embodiment of the present invention. The implementation illustrated in FIG. 31 is extended with decorrelation processing applied to any or all of the $L_{OUT}$ and $R_{OUT}$ output pairs. In this way, we can further increase the decorrelation between output speaker pairs. This concept is generalized in FIG. 33. In this case we are using allpass filters on all but the main output channels for additional decorrelation, but the scope of the embodiments includes any other suitable decorrelation methods.

Figure 34:
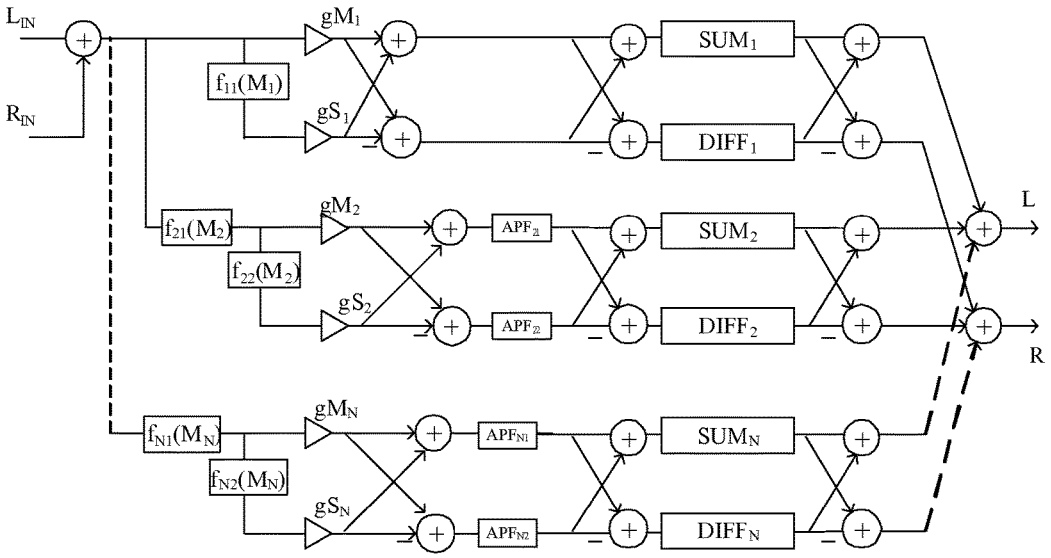
FIG. 34 is a diagram illustrating generalized 1-2N pseudo surround upmix with output decorrelation and output virtualization in accordance with one embodiment of the present invention.
Figure 35:
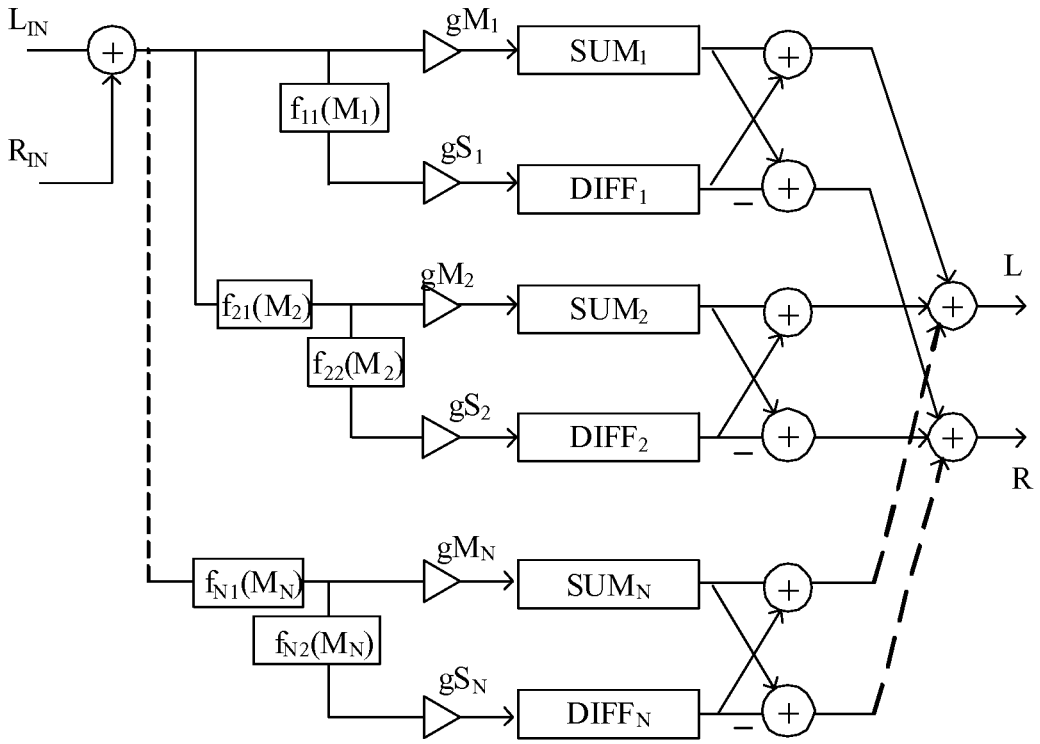
FIG. 35 is a diagram illustrating generalized 1-2N pseudo surround upmix with 2 channel output virtualization in accordance with one embodiment of the present invention.

In accordance with other embodiments, any of the above pseudo-stereo implementations are further enhanced by applying any headphone or speaker 3D audio virtualization technologies, including those described above, to the outputs of the pseudo stereo/surround algorithm. This concept is generalized in FIG. 34. FIG. 34 is a diagram illustrating generalized 1-2N pseudo surround upmix with output decorrelation and output virtualization in accordance with one embodiment of the present invention. SUMi and DIFFi represent the sum and difference stereo shuffler filter specifications of the i'th symmetrical virtual headphone or loudspeaker pair. In another variation, if these virtualization technologies are based on the M-S matrix, the virtualization operations can be integrated into the pseudo stereo topology, as demonstrated in the example FIG. 35. FIG. 35 is a diagram illustrating generalized 1-2N pseudo surround upmix with 2 channel output virtualization in accordance with one embodiment of the present invention.

Figure 36:
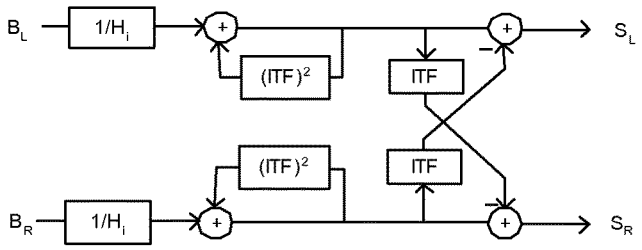
FIG. 36 is a diagram illustrating Schroeder Crosstalk canceller topology.

Cross-talk Canceller with Independent Control of Spatial and Spectral Attributes Assuming symmetric listening and a symmetrical listener, the ipsilateral and contralateral HRTFs between the loudspeaker and the listener's eardrums are illustrated in FIG. 4. In general, the aim of a crosstalk canceller is to eliminate these transmission paths such that the signal from the left speaker is head at the left eardrum only and the signal fro the right loudspeaker is hear at the right eardrum only. Some prior art structures use a simple structure that requires only two filters, the inverse of the ipsilateral HRTF (between the loudspeaker and the listener's eardrums) and an interaural transfer function (ITF) that represents the ratio of the contralateral to ipsilateral paths from speakers to eardrums. However, it has many disadvantages relating to its recursive nature. One such disadvantage is the constraint that, for all frequencies, the ITF is less than 1. Even if this condition is met, the topology can still become unstable if the input channels contain out-of-phase DC biases. The original crosstalk canceller topology used by Schroeder is shown in FIG. 36. While this topology should not suffer from the original problems relating to the cross-feed and feedback of input signals with DC offsets of opposite polarity, the constraint that ITF<1) still exists, and need to be even more rigorously applied, due to the presence of the $(ITF)^2$ filter in the feedback loop.

Figure 37:
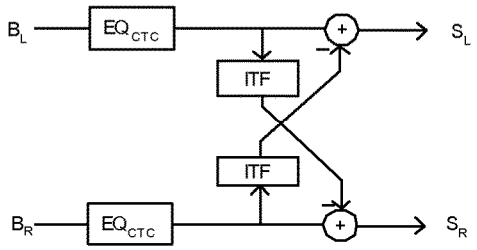
FIG. 37 is a diagram illustrating crosstalk canceller topology used in X-Fi audio entertainment mode in accordance with one embodiment of the present invention.

FIG. 37 is a diagram illustrating crosstalk canceller topology used in X-Fi audio creation mode in accordance with one embodiment of the present invention. According to the topology defined in embodiments of the present invention as shown in FIG. 37, the free-field equalization and the feedback loop of the Schroeder implementation are combined into a single equalization filter defined by $$EQ_{CTC} = \frac{1}{H_i\left(1-\left(\frac{H_c}{H_i}\right)^2\right)} = \frac{H_i}{(H_i^2 - H_c^2)} \tag{5}$$

Since this filter affects both channels equally and since the human auditory system is sensitive to phase differences only, the $EQ_{CTC}$ filter is implemented minimum phase in accordance with the present invention.

Figure 38:
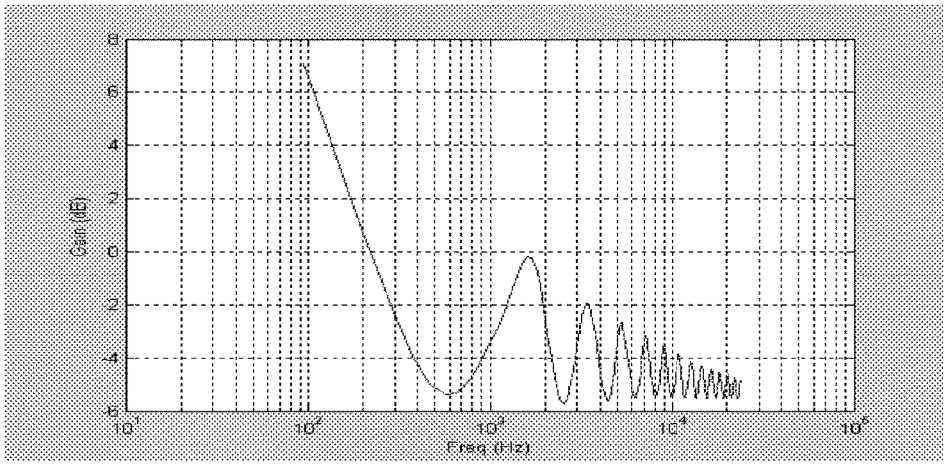
FIG. 38 is a diagram illustrating $EQ_{CTC}$ filter frequency response measured from HRTFs derived from a spherical head model and assuming a listening angle of ±30° in accordance with one embodiment of the present invention.

A typical $EQ_{CTC}$ curve is shown in FIG. 38. FIG. 38 is a diagram illustrating EQCTC filter frequency response measured from HRTFs derived from a spherical head model and assuming a listening angle of ±30° in accordance with one embodiment of the present invention. Like the $EQ_{DIFF}$ filter in the stereo shuffler configuration of FIG. 3, this filter exhibits significant low frequency gain. However, since this filter has no impact on the interaural phase, it can be limited to 0 dB below 200 Hz or so with no spatial consequences. The fact that there are no feedback paths in our new topology ensures that the system will always be stable if $EQ_{CFC}$ and ITF are stable, no matter what the gain of ITF is and regardless of the polarity of DC offsets at the input.

In fact, because $EQ_{CTC}$ can now be used to equalize the virtual sources reproduced by our crosstalk canceller without affecting the spatial attributes of the virtual source positions. This is useful in optimizing the crosstalk canceller design for particular directions (for example, left surround and right surround in a virtual 5.1 implementation).

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for upmixing a 2 channel audio signal to 2N output channels distributed as N left, right pairs using N shuffler matrices comprising:

(1) generating a sum signal and a difference signal in an M-S shuffler matrix to represent mid and side contributions from the 2 channel audio signal;

(2) applying a first filter to the sum signal to generate a first filtered signal;

(3) applying a second filter to the difference signal to generate a second filtered signal;

(4) generating from the sum and difference of the first filtered signal and the second filtered signal an output channel pair for the M-s Shuffler matrix; and repeating steps (1), (2), (3) and (4) for each of the N M-S shuffler matrices wherein gains on the first and the second filters are tuned to redistribute the mid (M) and side (S) contributions from the 2 channel audio signal across the 2N output channels and wherein N is greater than or equal to two.

2. The method as recited in claim 1 wherein the gains are selected to satisfy a predetermined energy preservation characteristic.

3. The method as recited in claim 1 wherein the 2N output channels include front channels and back channels and further comprising controlling front-back energy distribution over the front channels and the back channels by controlling the sum (M) and/or difference (S) components through user provided controls.

4. The method as recited in claim 1 wherein the 2N output channels include front channels and back channels and further comprising decorrelating the back channels (B) relative to the front channels (F).

5. The method as recited in claim 1 further comprising combining the gains with virtualization filters.

6. The methods as recited in claim 1 wherein the 2N output channels include front channels and back channels and further comprising reducing a width of a frontal audio image by setting a sum fader to the front channels and a difference fader to the back channels.

7. The method as recited in claim 1 further comprising applying early reflections to a virtual loudspeaker rendering provided by the 2N output channels and tuning the gains provided on the first and second filters to tune a selected balance of mid versus side components.

8. An audio processing device for processing an audio signal having at least two channels, comprising:

a processor configured to generate a sum signal and a difference signal from the audio signal; and to apply a first filter to the sum signal and a second filter to the difference signal; wherein the device is further configured to apply a crossfade to each of the sum signal and the difference signal, the crossfade blending an output of the first filter with a bypass of the first filter and blending an output of the second filter with a bypass of the second filter to control the amount of the resulting audio signal effect by respectively scaling the sum signal and the difference signal.

9. The device as recited in claim 8 wherein the processor is further configured to process a single channel audio signal and to derive a synthetic difference signal component from the input single channel audio signal; and wherein the processor is configured to apply a first filter to a sum signal represented by the single channel signal and to apply a second filter to the synthetic difference signal; and configured to apply a crossfade to each of the sum signal and the synthetic difference signal, the crossfade blending an output of the first filter with a bypass of the first filter and blending an output of the second filter with a bypass of the second filter to control the amount of the resulting audio signal effect by respectively scaling the sum signal and the synthetic difference signal.

10. An audio processing device for upmixing a two channel audio signal to 2N output channels distributed as N left, right pairs using N shuffler matrices comprising:

a first M-S shuffler matrix including processor configured to generate a sum signal and a difference signal from the audio signal; and configured to apply a first filter to the sum signal and to apply a second filter to the difference signal; and to generate the first of the 2N output channels as a sum signal and a difference signal from the filtered signals, and further comprising a control module configured to tune gains on the first and the second filters to redistribute mid and side contributions from the two channel audio input across the 2N output channels.

11. The audio processing device of claim 10 wherein the two channel audio signal is a stereo signal.

* * * * *